US006437661B2

(12) United States Patent
Nishimura et al.

(10) Patent No.: US 6,437,661 B2
(45) Date of Patent: Aug. 20, 2002

(54) DIRECTIONAL COUPLER

(75) Inventors: Hiroaki Nishimura; Yukinori Miyake, both of Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/817,169

(22) Filed: Mar. 27, 2001

(30) Foreign Application Priority Data

Mar. 29, 2000 (JP) ..... 2000-091775

(51) Int. Cl.[7] ..... H01P 5/18
(52) U.S. Cl. ..... 333/116; 333/246
(58) Field of Search ..... 333/116, 246; 361/799; 174/50

(56) References Cited

U.S. PATENT DOCUMENTS

| | | | | |
|---|---|---|---|---|
| 4,375,054 A | | 2/1983 | Pavio | |
| 4,394,630 A | | 7/1983 | Kenyon | |
| 4,486,621 A | * | 12/1984 | Morisot et al. | 174/50 |
| 4,823,097 A | | 4/1989 | Konishi | |
| 4,827,380 A | * | 5/1989 | Watanabe et al. | 361/502 |
| 5,446,425 A | | 8/1995 | Banba | |

FOREIGN PATENT DOCUMENTS

| | | | |
|---|---|---|---|
| DE | 1230105 | 9/1964 | |
| DE | 1268234 | 4/1967 | |
| DE | 2041484 | 2/1972 | |
| DE | 2202595 | 7/1973 | |
| DE | 9409625 | 8/1994 | |
| EP | 0777289 | 6/1997 | |
| FR | 1557098 | 2/1969 | |
| JP | 60-247304 | * 12/1985 | H01P/5/18 |

* cited by examiner

*Primary Examiner*—Robert Pascal
*Assistant Examiner*—Dean Takaoka
(74) *Attorney, Agent, or Firm*—Kanesaka & Takeuchi

(57) ABSTRACT

A directional coupler (21) comprises main and auxiliary lines (27, 30) between dielectric boards (23, 24), a ground plate (25) provided on the outer face of the dielectric boards (23), and a conductive case (34) covering the dielectric boards (23) and (24) and making contact with the ground plate (25).

3 Claims, 4 Drawing Sheets

DIRECTIONAL COUPLER

BACKGROUND OF THE INVENTION

1. Field of the Invention

The present invention relates to microwave couplers and, more particularly, to a triplate system directional coupler.

2. Description of the Related Art

There are many systems of microwave couplers. One example is a triplate system of directional couplers that are used in cellar phone stations.

A conventional triplate system directional coupler 1 is shown in FIGS. 5–8. The triplate system directional coupler 1 is composed of laminated plates. It comprises an intermediate dielectric board 2, first and second dielectric boards 3 and 4 for supporting the intermediate dielectric board 2 between them, first and second ground plates 5 and 6 provided on outer faces of the first and second dielectric boards 3 and 4, respectively, and a pair of first side ground plates 7 and 7' and a pair of second side ground plates 8 and 8' provided on side faces of the intermediate, first, and second dielectric boards 2, 3, and 4.

A pair of main tabs 10 are in contact with opposite ends of a main line (not shown) of copper foil that is provided on a face 9 of the intermediate dielectric board 2. A pair of auxiliary tabs 12 are in contact with opposite ends of an auxiliary line (not shown) of copper foil that is provided on the other face 11. Opposite ends 13–13' and 14–14' of the first and second side ground plates 7 and 7' and 8 and 8' are bent inwardly by 90 degrees and inserted between the first dielectric board 3 and the first ground plate 5, and the second dielectric board 4 and the second ground plate 6, respectively, for being joined together. Notches 15 are provided at positions corresponding to the main and auxiliary tabs 10 and 12 of the first side ground plates 7 and 7'.

To assemble the triplate system directional coupler 1, first of all, the intermediate dielectric board 2 is held between the first and second dielectric boards 3 and 4, and the opposite ends 13, 13', 14, and 14' of the first and second side ground plates 7, 7', 8, and 8' are engaged with the first and second dielectric boards 3 and 4, respectively. Then, the opposite ends 13, 13', 14, and 14', the intermediate dielectric board 2, and the first and second dielectric boards 3 and 4 are held between the first and second ground plates 5 and 6. Two grommets 16 and four rivets 17 are put through the opposite ends 13, 13', 14, and 14' of the first and second side ground plates 7, 7, 8, and 8', the intermediate dielectric board 2, the first and second dielectric boards 3 and 4, the first and second ground plates 5 and 6, and their ends are deformed to join the respective components together.

In the above directional coupler, however, the respective components are joined together with the grommets 16 and the rivets 17 so that it is necessary to provide a space for the grommets 16 and rivets 17, resulting in the large plane area of the directional coupler. In addition, the first and second side ground plates 7, 7', 8, and 8' and the rivets 17 require much labor for assembling. If there is a gap between the respective ends 13, 13', 14, and 14' of the first and second side ground plates 7, 7', 8, and 8', the required ground and shield characteristics are not assured. For this reason, high precision work is required for the first and second side ground plates 7, 7', 8, and 8', requiring much labor.

SUMMARY OF THE INVENTION

Accordingly, it is an object of the invention to provide a compact directional coupler capable of simplifying the manufacture process and reducing the manufacturing cost.

According to the invention there is provided a directional coupler which comprises a plurality of dielectric boards; main and auxiliary lines provided between the dielectric boards; a ground plate provided on an outer face of one of the dielectric boards; and a conductive case provided over the dielectric boards so as to make contact with the ground plate.

It is preferred that the conductive case, the dielectric boards, and the ground plate are joined with grommets or rivets, or deformation of a part of the conductive case on the ground plate.

DESCRIPTION OF THE PREFERRED EMBODIMENT

Embodiments of the invention will now be described with reference to the accompanying drawings.

Figure 1:
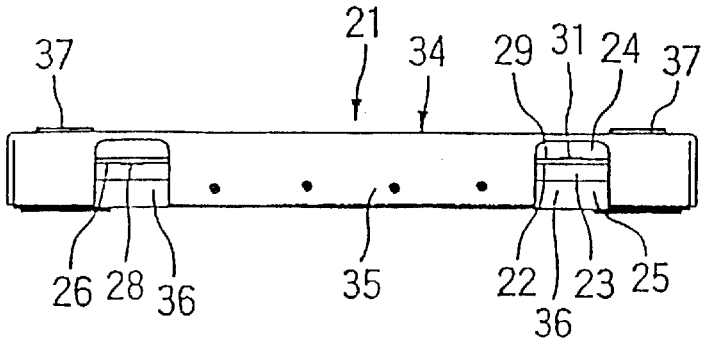
FIG. 1 is a front elevational view of a directional coupler according to an embodiment of the invention.
Figure 2:
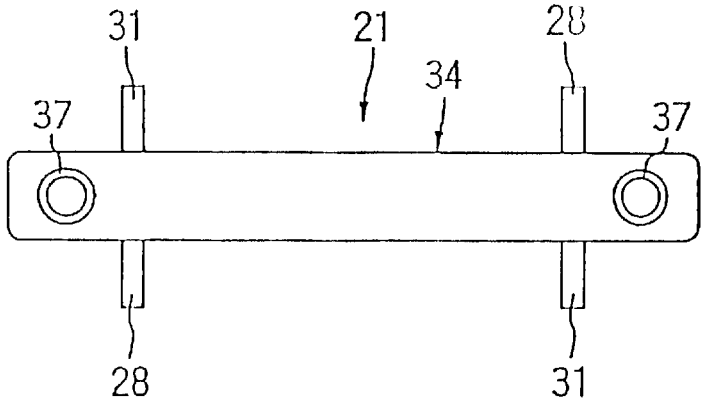
FIG. 2 is a top plan view of the directional coupler.
Figure 3:
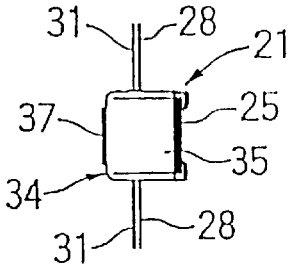
FIG. 3 is a side elevational view of the directional coupler.
Figure 4:
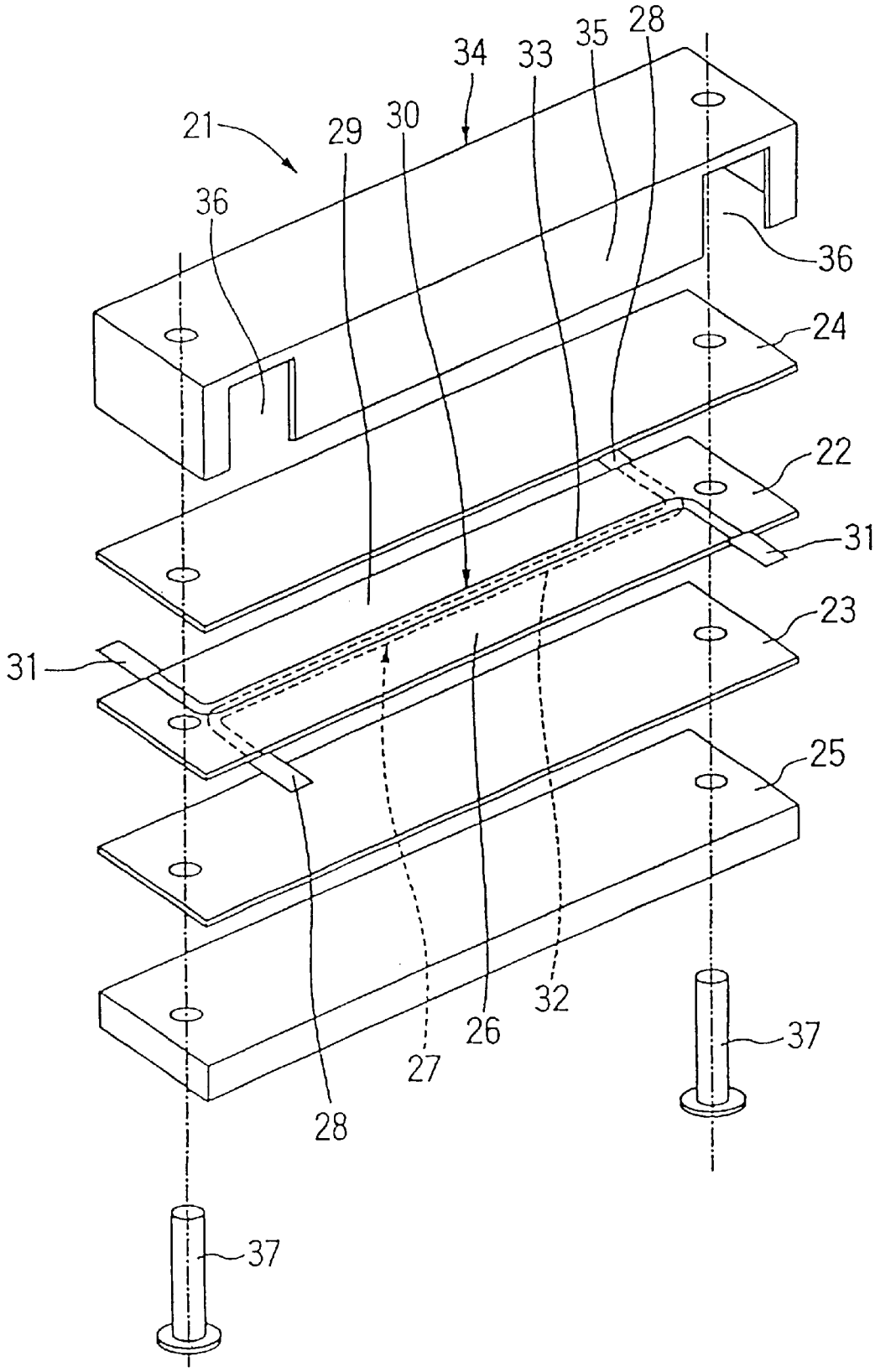
FIG. 4 is an exploded perspective view of the directional coupler.
Figure 5:
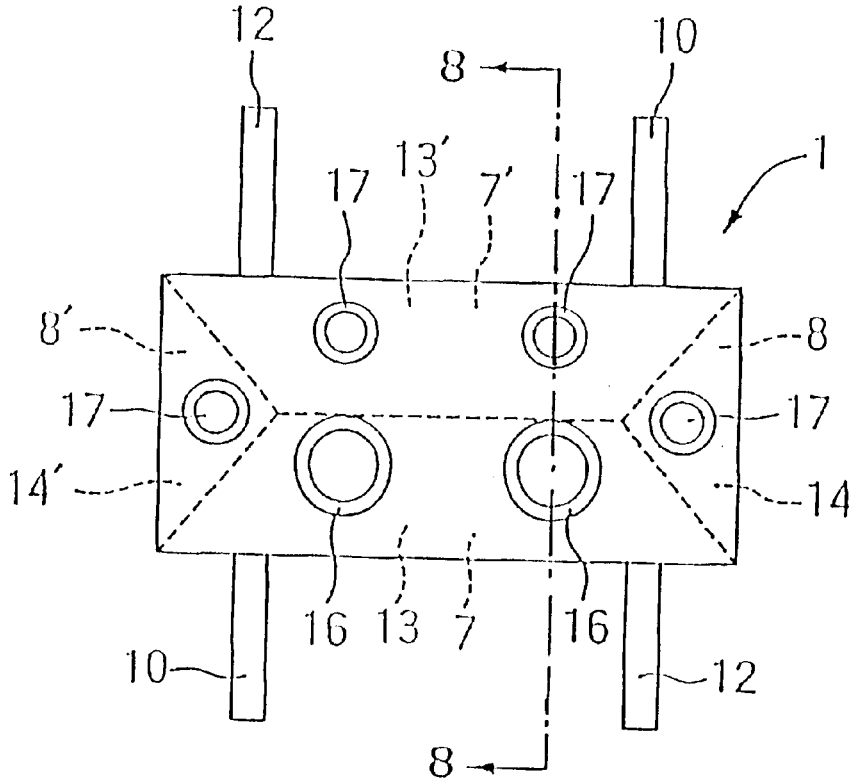
FIG. 5 PRIOR ART
FIG. 5 is a top plan view of a conventional directional coupler.
Figure 6:
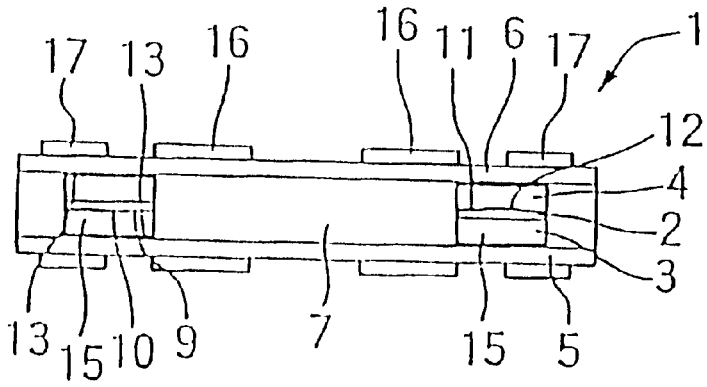
FIG. 6 PRIOR ART
FIG. 6 is a front elevational view of the conventional directional coupler.
Figure 7:
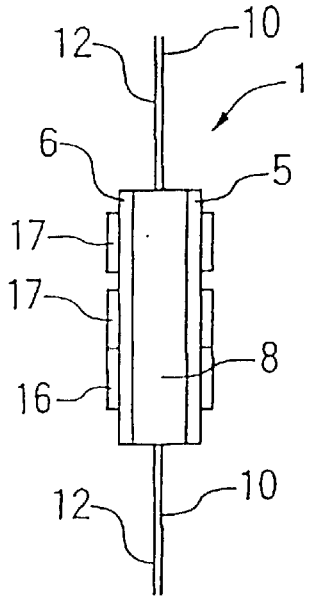
FIG. 7 PRIOR ART
FIG. 7 is a side elevational view of the conventional directional coupler.
Figure 8:
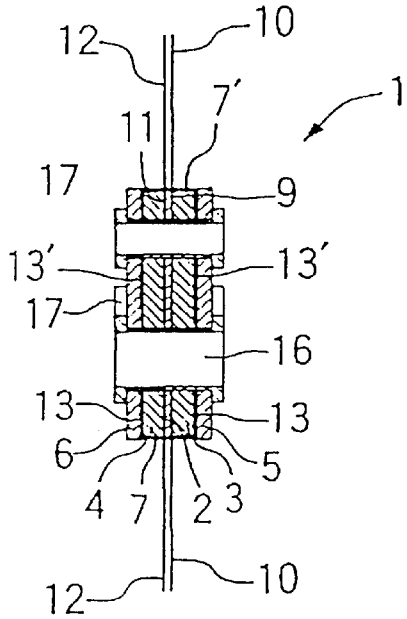
FIG. 8 PRIOR ART
FIG. 8 is a sectional view taken along line 8—8 of FIG. 5.

In FIGS. 1–4, a triplate system directional coupler 21 comprises an intermediate dielectric board 22, first and second dielectric boards 23 and 24 to hold the intermediate dielectric board 22 between them, and a ground plate 25 provided on the outer face of the first dielectric board 23. A main line 27 of copper foil is provided on a face 26 of the intermediate dielectric board 22 and connected at opposite ends to main tabs 28. An auxiliary line 30 of copper foil is provided on the other face 29 and connected at opposite ends to auxiliary tabs 31. Coupling sections 32 and 33 of the main and auxiliary lines 27 and 30 overlap and the corresponding main and auxiliary tabs 28 and 31 extend in opposite directions.

The conductive case 34 is made in the form of a box so as to cover the outer face of the second dielectric board 24 and the sides of the intermediate dielectric board 22 and the first and second dielectric boards 23 and 24, and the side walls 35 make contact with the ground plate 25. Notches 36 are provided in the side walls 35 of the conductive case 34 at positions corresponding to the main and auxiliary tabs 28 and 31, respectively.

How to assemble the triplate system directional coupler will be described.

The intermediate dielectric board 22 is held between the first and second dielectric boards 23 and 24, and the ground plate 25 is put on the outer face of the first dielectric board 23. Then, the conductive case 34 is put over the second dielectric board 24, the intermediate board 22, and the first dielectric board 23, and grommets 37 are put through the ground plate 25, the first, intermediate, and second dielectric boards 23, 22, and 24, and the conductive case 34, and their ends are deformed to join them together. Since the conductive case 34 is put over the respective dielectric boards 22, 23, and 24, these components are joined together without the use of any fastener such as rivet.

After the conductive case 34 is put over the dielectric boards 22, 23, and 24, their side walls 35 may be punched or screwed onto or deformed around the sides of the ground plate 25 so as to provide firmer and closer attachment of the conductive case 34 to the ground plate 25, thereby enhancing the ground and shield characteristics.

Alternately, the main and auxiliary lines 27 and 29 may be provided on the same face of a dielectric board and held between the dielectric board and another dielectric board. The wiring patterns for the main and auxiliary lines 27 and 29 may vary.

As has been described above, according to the invention, no fastener, such as rivet, is needed so that the space for fastener is eliminated, leading to a compact directional coupler, reduction in the number of components, a simple manufacture process, and/or a low manufacturing cost. By punching or deforming the side walls of a conductive case onto or around the sides of the ground plate, it is possible to attach the conductive case more firmly and closely to the ground plate, thus improving the ground and shield properties.

What is claimed is:

1. A directional coupler comprising:

a conductive case made in a form of a box and having side walls and notches provided on said side walls;

a plurality of dielectric boards provided in said conductive case;

a main line having a pair of main tabs and an auxiliary line having a pair of auxiliary tabs, said main and auxiliary tabs provided at positions corresponding to said notches of said conductive case;

a ground plate provided on an outer face of one of said dielectric boards and having side walls making contact with said side walls of said conductive case; and at least one grommet for joining together said dielectric boards, ground plate, and conductive case.

2. The directional coupler according to claim 1, wherein at least one of side walls of said conductive case is punched to one of said side walls of said ground plate.

3. The directional coupler according to claim 1, wherein at least one of said side walls of said conductive case is deformed so as to engage said ground plate.

* * * * *